US012611034B2

(12) United States Patent
Cheney et al.

(10) Patent No.: US 12,611,034 B2
(45) Date of Patent: Apr. 28, 2026

(54) READY TO ASSEMBLE FURNITURE SYSTEM

(71) Applicant: Ashley Furniture Industries, LLC, Arcadia, WI (US)

(72) Inventors: Chad Cheney, Pontotoc, MS (US); Thad Ross, Thaxton, MS (US)

(73) Assignee: Ashley Furniture Industries, LLC., Arcadia, WI (US)

( * ) Notice: Subject to any disclaimer, the term of this patent is extended or adjusted under 35 U.S.C. 154(b) by 165 days.

(21) Appl. No.: 18/479,627

(22) Filed: Oct. 2, 2023

(65) Prior Publication Data

US 2024/0108138 A1 Apr. 4, 2024

Related U.S. Application Data

(60) Provisional application No. 63/412,016, filed on Sep. 30, 2022.

(51) Int. Cl.

| | |
|---|---|
| ***A47C 4/02*** | (2006.01) |
| ***A47C 13/00*** | (2006.01) |
| ***A47C 17/04*** | (2006.01) |

(52) U.S. Cl.

CPC ..... *A47C 4/02* (2013.01); *A47C 13/005* (2013.01); *A47C 4/028* (2013.01); *A47C 17/04* (2013.01)

(58) Field of Classification Search

CPC ..... A47C 4/02; A47C 4/028; A47C 13/005; A47C 17/04

See application file for complete search history.

(56) References Cited

U.S. PATENT DOCUMENTS 3,774,966 A * 11/1973 Faulkner ..... A47C 4/02 297/440.23
4,765,678 A * 8/1988 Huang ..... A47C 13/005 5/18.1

(Continued)

FOREIGN PATENT DOCUMENTS

CN 307384650 6/2022
GB 2151131 A * 7/1985 ..... A47C 4/02

OTHER PUBLICATIONS

International Preliminary Report of Patentability in International Patent Application No. PCT/US2023/034252, dated Apr. 10, 2025, 14 pages.

(Continued)

*Primary Examiner* — Rodney B White
(74) *Attorney, Agent, or Firm* — Christensen, Fonder, Dardi & Busse PLLC.; Douglas J. Christensen; Andrew H. Auderieth

(57) ABSTRACT

A ready-to-assemble furniture ("RTA") system in which a seat, such as a sofa, comprises a seat base with a seating portion having a pair of preattached arm rests on opposing sides of the seating portion, and a separate backrest. The sofa has a transport configuration where the backrest nests on the base between the arm rests and is convertible to a use configuration by a simple upward lifting of the backrest, a partial rotation of the backrest of about 90°, lowering of the backrest onto elongate polymer KD brackets having a rearward inclination on the arm rests until a pair of slots of the backrest panelar side members is seated on the KD brackets. Each KD bracket having a wedge portion at the arm rest surface and a flange portion displaced from the arm rest. The seat may be boxed with instructions for assembly attached to the sofa.

1 Claim, 11 Drawing Sheets

(56) References Cited

U.S. PATENT DOCUMENTS

| | | | | |
|---|---|---|---|---|
| 4,932,720 | A * | 6/1990 | Sherman | A47C 4/02 297/440.16 |
| 5,183,523 | A | 2/1993 | Rinehart | |
| D333,936 | S | 3/1993 | van der Zanden | |
| D349,624 | S | 8/1994 | Fraser | |
| 6,367,880 | B1 * | 4/2002 | Niederman | A47C 4/02 297/440.14 X |
| 6,783,182 | B1 * | 8/2004 | Gallagher | A47C 4/02 297/440.14 X |
| D753,412 | S | 4/2016 | Anderson | |
| 9,380,877 | B2 * | 7/2016 | Brandtner | A47C 4/028 |
| 9,420,892 | B2 * | 8/2016 | Lejcher | A47C 4/028 |
| 9,474,381 | B2 * | 10/2016 | Brandtner | A47C 17/02 |
| 9,759,008 | B2 | 9/2017 | Anderson | |
| D799,856 | S | 10/2017 | Fujita | |
| 9,839,295 | B2 * | 12/2017 | Robinson | A47C 3/00 |
| D838,803 | S | 1/2019 | Washburn, III | |
| D874,370 | S | 2/2020 | Ray | |
| 10,980,354 | B2 * | 4/2021 | Ross | A47C 7/32 |
| 11,344,135 | B2 * | 5/2022 | Gates | A47C 17/02 |
| 11,607,044 | B2 * | 3/2023 | Brandtner | A47C 1/02 |
| 11,696,644 | B2 * | 7/2023 | Brandtner | A47C 31/02 297/440.23 |
| D1,025,752 | S | 5/2024 | Cheney et al. | |
| 2002/0017814 | A1 * | 2/2002 | Niederman | A47C 4/028 297/440.22 X |
| 2002/0093235 | A1 * | 7/2002 | Niederman | A47C 4/028 297/440.1 |
| 2003/0111882 | A1 * | 6/2003 | Niederman | A47C 4/028 297/232 |
| 2005/0006943 | A1 * | 1/2005 | Wieland | A47C 4/021 297/440.13 |
| 2010/0270844 | A1 | 10/2010 | Hood | |
| 2013/0320741 | A1 | 12/2013 | Brandtner et al. | |
| 2020/0245773 | A1 * | 8/2020 | Policicchio | A47C 1/124 |
| 2021/0093087 | A1 * | 4/2021 | Zei | A47C 4/028 |
| 2021/0196049 | A1 * | 7/2021 | McCreary | A47C 17/04 |
| 2021/0289941 | A1 | 9/2021 | Brandtner et al. | |
| 2022/0053945 | A1 | 2/2022 | Lewis et al. | |
| 2022/0071398 | A1 | 3/2022 | Brandtner et al. | |
| 2022/0346561 | A1 * | 11/2022 | Wang | A47C 4/028 |
| 2022/0354261 | A1 * | 11/2022 | Aubé | A47C 13/005 |
| 2023/0038420 | A1 * | 2/2023 | Eglinton | A47C 4/02 |
| 2023/0200545 | A1 * | 6/2023 | McCreary | A47C 13/005 297/440.14 |
| 2025/0040712 | A1 * | 2/2025 | Eglinton | A47C 4/02 |
| 2025/0040720 | A1 * | 2/2025 | Williams | A47C 13/005 |
| 2025/0072620 | A1 * | 3/2025 | Zhao | A47C 7/383 |

OTHER PUBLICATIONS

International Search Report and Written Opinion in International Patent Application No. PCT/US2023/034252, dated Jan. 17, 2024, 18 pages.

* cited by examiner

READY TO ASSEMBLE FURNITURE SYSTEM

This application claims priority to U.S. Provisional Patent Application No. 63/412,016 filed Sep. 30, 2022.

FIELD OF THE INVENTION

The present invention is generally directed to ready to assemble seats and interface components and related methods for securing together subcomponents of such seats.

BACKGROUND OF THE INVENTION

Furniture items used for seating commonly comprise a support structure covered by upholstery and/or cushioning. In particular, sofas typically comprise a seat base, a backrest and a pair of arm rests. A common aesthetic and practical design consideration is assembling the sofa to minimize the visible gaps between the subcomponents. Additionally, such furniture needs to be structurally stable, for the life of the furniture piece, with no movement between components, that is, no wobble. Of course, the components need to be properly aligned during assembly; misaligned subcomponents can form an uneven edge between the subcomponents creating an unpleasant aesthetic appearance. Typically, sofas are fully assembled at the furniture factory by factory workers or machinery to ensure the individual subcomponents are properly assembled and aligned to minimize the appearance of visible gaps or uneven edges in the assembled furniture item.

The inherent drawback of assembling the furniture item at the factory is that the L-shape of the back and seat rest assembly typical of the seating portion of sofas often prevents efficient packing of the furniture items for transport. Depending on the shape and size of subcomponents of the furniture item, inefficient packing of the furniture item can result in a significant amount of dead space within the shipping container or truck. In addition to increasing the cost of transportation, the dead space can allow the furniture items to shift during transport resulting in damage to the furniture item. Similarly, the awkward shape of the assembled furniture items can make it difficult to navigate into or through a home or other structure without significant positioning and reorienting of the furniture item.

An approach to addressing the drawbacks of factory assembled furniture items comprises providing individually upholstered subcomponents as a ready to assemble ("RTA") furniture kit that can be assembled by the end user. Such furniture is often called Knock Down or KD furniture. The individual subcomponents can be more efficiently packed than the fully assembled furniture item and allows the furniture item to be assembled in situ, thereby eliminating the need for navigating the assembled furniture item through the building. However, the inherent challenge of providing RTA furniture kits is that the consumers who assemble the furniture kits are typically unfamiliar with furniture assembly and may not have the experience or ready access to the tools necessary to properly assemble the subcomponents. In addition, manually aligning the often heavy and large subcomponents to install the fasteners for connecting the subcomponents can be difficult, particularly if a single individual is assembling the furniture item. Moreover, as the number of subcomponents assembled together increases, maneuvering the components becomes increasingly challenging as the weight and bulkiness of the assembly increases. A similar concern is that if the fasteners linking the subcomponents are not properly installed, the structural integrity of the furniture item could be compromised resulting in premature failure of the furniture item.

Another challenge of RTA furniture kits is affixing fasteners to pre-upholstered furniture subcomponents can be difficult. With most RTA furniture kits, the interface surfaces between the various subcomponents are typically not easily accessible from the exterior of the furniture item following assembly. A common approach of accessing the interfacing surfaces is through the bottom of the seat box of the furniture item. However, this approach typically requires upending the couch and fastening the subcomponents while the furniture item is balanced on its side or back. To some extent these issues have been addressed such as by U.S. Pat. No. 9,474,381, owned by the owner of this application. Said patent is incorporated by reference herein for all purposes. However, it would still be well received by the consuming public to minimize or eliminate the use of fasteners connecting components in RTA furniture.

Typical interface components in RTA furniture comprise cooperating metal brackets. Such brackets typically require very close pre-alignment of furniture components for proper assembly. Also, these brackets provide sharp metal corners and catch edges that can damage other furniture components if misaligned or walls and the like during moving the components through residential spaces. Such metal brackets are often not readily amenable to disassembly. Additionally, such metal cooperating brackets provide spacing between the respective panels or other furniture frame members to which they are connected which must be accommodated in the furniture design and which may lead to lack of rigidity in the assembled furniture and a tendency to become wobbly over time. Some improvements have been made to RTA furniture brackets such that brackets may be made from polymers. See, for example, U.S. Pat. No. 9,380,877, owned by the owner of this application and incorporated by reference herein for all purposes. Improvements in furniture with polymer RTA brackets making assembly intuitive and simple with the assembled furniture being more robust would be well received by the consuming public. Any other improvements where there are fewer parts and where the components to be assembled, as well as the assembled sofa, would weigh less that current configurations, would be well received by manufacturers and the consuming public.

SUMMARY OF THE INVENTION

The present invention is generally directed to a ready-to-assemble furniture ("RTA") system in which a seat, such as a sofa, comprises a seat base with a seating portion and a pair of preattached arm rests on opposing sides of the seating portion, and a separate backrest component. The sofa has a transport configuration or mode where the backrest nests on the base between the arm rests and is convertible to a use configuration or mode by a simple upward lifting of the backrest, a partial rotation of the backrest of about 90°, lowering of the backrest onto elongate polymer KD brackets angularly positioned on the arm rests until the backrest is seated on the KD brackets and on a rearward portion of the seating portion.

In embodiments, the polymer elongate KD brackets affixed to respective inward facing arm rest panels of each of the pair of arm rests. Each elongate polymer KD bracket having a lengthwise axis mounted with an upright and rearward incline. Each elongate polymer KD bracket positioned above and rearward of the seating portion. The backrest having slots defined in outer frame members, configured as upright panels, of the backrest. Each of the slots configured to conformingly receive and capture the respective elongate polymer KD bracket such that a flange of the KD bracket is in the interior of the backrest and each arm rest surface of the base directly engages a respective side of the backrest. That is, there is no gap between the confronting panel surfaces of the arm rest portion and the side of the backrests as would be present with conventional cooperating pairs of steel KD brackets.

In embodiments, the KD bracket having a wedge shape with a leading end that enters the slot being of a narrow width that the opposite trailing end. The slot that receives the wedge shaped KD bracket having a wider opening, a converging opening such as a funnel shape, and straight edge surfaces that conform to the wedge shape of the opposite sides of the KD bracket. The wider opening of the slot and the reduced thickness of the leading end of the bracket facilitates easy assembly by the end user. Additionally, the wedge shaped KD bracket engaged with a conformingly shaped slot provides more robust interface than comparable slots with parallel edges and KD brackets that are not elongate and that are not wedge shaped. The more robust interface combined with the easier assembly are features and advantages of embodiments. The more robust interface provides a more robust and connection between the connected components.

In embodiments, the KD sofa may be shipped in a box with the material covered backrest positioned on the material covered seat base, nested between the arm rests, with a lower forward margin of the backrest seated against or proximate the pair of the elongate polymer brackets. When the seat and backrest are removed from the box, the backrest may be simply raised and rotated rearwardly so that the slots on the panel frame members of the backrest engage the respective elongate polymer brackets, and then the backrest is lowered onto the brackets and such that the lower forward margin of the backrest seats on a rearward portion of the seating portion of the base. A feature and advantage of embodiments is that no fasteners are needed or utilized during the assembly of the KD sofa. A feature and advantage of embodiments are that the slots into which the elongate polymer brackets are received are directly adjacent to the brackets when the sofa is in the packed transport configuration. Such positioning and simple assembly steps facilitate minimal needed assembly instructions. Such instructions by be positioned and attached permanently on the sofa on locations that are visible in the transport configuration but covered or otherwise not visible in the use configuration. When the seat base and backrest are in the use configuration, the seat cushions may then be positioned on the seating portion of the base. The seat cushions may be stowed in the seat base, or backrest when the sofa is boxed and shipped, or on top of the backrest, for example.

In embodiments, a ready to assemble seat, such as a sofa, has a seat base with a U-shape when viewed from the front or rear with a seating portion defining the lower portion of the U and a pair of arm rests defining lateral side legs of the U, and further has a U-shaped footprint when viewed from above with rearward portions of the arm rests defining lateral legs of the U and the seating portion defining the lower portion of the U. The ready to assemble seat may be shipped in a box in a transport configuration with a backrest positioned on seat base, in an open region, within the U shape when viewed from the front or rear. Upon unboxing, the backrest may be simply raised and rotated rearwardly and lowered to an upright position such that when viewed from above, the backrest is positioned within the U of the U-shaped footprint wherein the ready to assemble seat is in a use configuration.

In embodiments, a pair of elongate brackets are attached to the arm rests and extend into the interior of the U of the seat base when viewed from the front or the rear and extend into the interior of the U of the U-shaped footprint of the seat base when viewed from above. When the backrest is raised, partially rotated rearwardly, and lowered into an upright use position within the U of the U-shaped footprint of the seat base, the pair of brackets are received into a pair of slots on sides of the backrest. In embodiments, the pair of slots are formed in side panel frame members of the back rest with the slots extending into an interior of the backrest. A feature and advantage of embodiments is that the slots that engage with the brackets attached to the arm rests are formed in side panel frame members of the backrest and the structure defining the slots does not project outwardly from the side panel frame members. In embodiments, the brackets are elongate brackets positioned with a rearward inclination of lengthwise axis of the brackets. In embodiments, the brackets are elongate polymer brackets with a pair of side surfaces for engaging the side panel frame members, the pair of side surfaces converging in an upwardly direction. In embodiments, the brackets having a flange projecting from the side surfaces, the flange separated from the arm rest surfaces upon which the brackets are mounted.

In embodiments, the elongate brackets are metal KD brackets and the slots are defined by cooperating KD brackets attached to panel side frame members of the backrest.

In embodiments, the distance between the attached arm rests of the base is sized to the width of the backrest, with parallel confronting surfaces, such that a secure assemblage is provided when boxed and shipped.

A feature and advantage of embodiments is that the force vector from users' backs when being seated on the sofa is substantially perpendicular to the axis of the elongate polymer KD brackets, and substantially perpendicular to the elongate planar forward face of the elongate polymer KD bracket with is engaged with a cooperating edge portion that defines the slot. The brackets precisely positioned on the arm rests such that when the backrest is assembled onto the seat, the downward facing forward lower margin of the backrest seats on the rearward upper surface of the base. In embodiments, the forward lower margin of the backrest is defined by breast board frame member covered with material, and the rearward upper surface of the base is at a rearward spanning rail of the seat base frame, the rearward spanning rail extending between respective arm rest frames.

A feature and advantage of embodiments is that only a single KD bracket is utilized on each side of the seat base, and that KD bracket configuration is configured for use on both the left and right sides of the seat base, and the elongate polymer KD bracket is secured in a stable and robust manner on the arm rests. The elongate polymer bracket having an outward exposed side and an attachment side. Attachment holes positioned in a plurality of bosses extend from the outward exposed side to the attachment side. A circumferential wall with side walls extending in a closed geometric shape, in embodiments, defines interface surfaces at the attachment side for connecting with the arm rests, further defines backrest bearing and engaging surfaces for engagement with the backrest at the backrest slots, and further defines an interior of the bracket. The circumferential wall unitary with a flanged wall on the outward exposed side. In embodiments, the outer flanged wall having a flange portion with a skirt portion that extends from a flat outer surface of the outer flanged wall toward the attachment side of the bracket. The interior of the bracket may have polymer webbing extending in at least two directions, for example in the lengthwise direction of the elongate KD bracket and in a direction transverse to the lengthwise direction. The webbing being unitary with the circumferential wall, unitary with the outer flanged wall, and unitary with the plurality of bosses. The webbing having an edge surface that is flush with the flat surface at the attachment side of the bracket. The webbing may comprise individual separate webs or webs unitary with each other. The webbing may be in a grid pattern when viewed from the attachment side. Webbing may be provided in conjunction with the flange portion extending out from the wedge portion, for example interior of the skirt portion.

A feature and advantage of embodiments is that the KD bracket may be repeatedly precisely attached in the exact needed location during production of the sofa wood components such that the precise alignment and permanent robust support of the backrest at the KD bracket and at the upper rearward margin of the seating portion of the seat base is provided. Such precise location is accomplished during the production of the arm rest upright inward panels with holes drilled with precise locations and with threaded nut inserts provided in the hole for receiving the plurality of bolts that extend through the bosses in the KD bracket and threadingly engage the nut insert in the upright inward panels. If the KD bracket loosens, it is easily retightened by the end user or a repair person since the bracket and bolt heads are readily visible and the nut insert is permanently imbedded in the respective upright inward panel of the arm rests.

A feature and advantage of embodiments is that the backrest and seat base are only connected to the seat base, that is, where the connection prevents forward or rearward movement or lateral movement, at the KD connectors and slot interfaces. The downward surface of a forward lower portion of the backrest is movable and seats upon the upward surface of the rearward upper portion of the seating portion of the seat base. That is, a middle lower portion of the backrest intermediate the KD brackets is slidingly engaged to the seat base such that the lower middle portion of the backrest may move rearwardly on the seat base under rearward passenger loading. The precise positioning of the KD brackets on the arm rests provide this sliding engagement of the backrest on the seating portion of the seat base. In embodiments, the seating portion may carry a portion of the weight of the backrest; in embodiments, the backrest may have a gap, between it and the seating portion. The material on the upward rearward surface of the seating portion may effectively provide a bearing surface upon which the backrest can resiliently move outward when under rearward force from occupants sitting and then rebound to the original position. Specifically, the backrest may flex rearwardly in an arc when excessive force is provided to the backrest when one or more individuals forcefully seat themselves, without putting any significant stresses on the seating portion of the seat base. This designed-in movement, where the backrest, intermediate the upright end panels of the backrest, is not fastened directly to the seat base, specifically the seating portion, allows absorption of such forceful seating by the flexing of the arm rest without loosening sofa frame member connections. A feature and advantage of embodiments is that the backrest may move rearward on the seating portion of the seat base with the material covering on the downwardly facing forward lower portion of the backrest sliding on the material covering the upwardly facing rearward portion of the seating portion of the seat base. This configuration takes stress off of the normal connections between frame members of the seat base and the arm rest which reduces frame components need to absorb that stress, resulting in a sofa with the features herein and that provides the advantages of fewer components and a sofa that resultingly weighs less.

A feature and advantage of embodiments is the configuration of and the position of the opening of the slot that receives the KD bracket. In the transport or storage configuration, the slot is in close proximity to the KD bracket and the slot extends to the lower edge of the end panels of the backrest such that a simple lift and partial rotation of the backrest aligns the opening of the slots with the KD brackets such that the KD bracket may be lowered onto the KD bracket. The reduced size of a leading end of the KD bracket, and the enlarged funnel shaped opening of the slots that receive the KD bracket on the backrest make the insertion by the end consumer/user very easy and intuitive. This configuration eliminates much of the component alignment needed in conventional RTA furniture with KD brackets. The enlarged funnel entry is readily cut into the upright panel frame members of the backrest whereas in the prior art, particularly where cooperating KD brackets were utilized, such size of a funnel entry configuration was not practical on cooperating KD brackets, particularly metal KD brackets.

In embodiments, each slot is defined by a cut sawed in each respective outer lateral panel frame member. In embodiments, the flange on elongate polymer KD bracket is spaced from inward facing panels of the respective arm rest to which they are attached a distance substantially equal to the thickness of the outer lateral panels of the backrest providing a secure and tight engagement of the brackets with the respective outer panel frame members when seated in the slot.

Each of the inward facing panels and the outer lateral panel frame members may have coverings such as fabric that facilitate the sliding engagement of the respective base and backrest components. In embodiments, the elongate flanged polymer brackets comprise an elongate base portion defining an attachment surface on an attachment side of the polymer bracket, with the flange being on the opposite side of the polymer bracket base. In embodiments, the base has opposing elongate planar base wall surfaces normal to a plane defined by the attachment surfaces, with the two elongate planar base wall surfaces converging as they approach an upper end of the bracket defining a taper. The upper end and an opposite lower end of the base portion each have rounded base wall surfaces with the radius of the rounded base wall surface of the lower end being greater than the radius of the rounded base wall surface of the upper end of the base portion of the bracket. In embodiments, the two opposing elongate planar base wall surfaces are parallel to one another and the radiuses of the two rounded base wall surfaces of the lower end and upper end being the same.

In embodiments, each polymer elongate flanged bracket has an lengthwise axis, when mounted extends in a direction generally upwardly and rearwardly at an angle from vertical in the range of about 20 degrees to about 45 degrees. In embodiments, the two opposing elongate planar edge engaging surfaces of the polymer KD bracket converge toward one another at a first or upper end (upper end when mounted on the arm rests)

In embodiments, the backrest has a wood frame with horizontally extending spanning wood frame members that extend the length of or substantially the length of the backrest, including a forward lower breast rail, an upper back rail, and a lowermost rearward back rail. Each of the breast rail, the upper back rail, and the lowermost rearward back rail are joined to a plurality of upright panel frame members configured as upright panels and include the two outer panel frame members with the respective slots.

In embodiments, the base comprises a base frame with the arm rests comprising arm rest frames and a forward base rail and a rearward base rail extending between the arm rest frames. The rearward base rail offset forwardly from a rearward margin of the arm rest frames. The arm rests project rearwardly beyond the rearward base rail.

In embodiments, when the backrest is assembled onto the base, the breast rail seats upon the rearward base rail of the base. In embodiments, the plurality of the backrest upright frame members seat upon the rearward base rail and extend downward. In embodiments, the lowermost rearward margin of the backrest extending is flush with rearward facing surfaces of the rearward arm rest portions and the lower margins of the arm rest portions.

The base and backrest may be box framed and formed from boards or panel members each formed of wood or wood products. "Panels" includes, for example, pieces of plywood or chip board or composite boards, or the like. The base and backrest of a chair or sofa may be packaged in a box including instructions for assembly without tools and with separate cushions for the seat and/or back.

A feature and advantage is that a polymer KD bracket, such as formed from polyethylene, or other common polymers, provides a "softer" interface with the sawn wood edges of the cooperating slot in the wood or wood product panel side members compared to, for example, a metal bracket, thereby minimizing damage to the wood edges defining the slot during assembly and during use.

In one aspect, the slot in the backrest can further comprise a polymer lining of the slot in the slots in the backrest panel frame member. The polymer lining facilitating movement of the KD bracket through the slot without damaging the slot in the wood panel member, which is typically plywood or wood product. See U.S. Pat. No. 9,380,877 owned by the owner of this application and incorporated by reference herein for all purposes. In certain aspects of the present invention, the edges of the slots can be shaped to engage the retention elements as the retention element is being slid through the slot to adjust to the relative alignment of the subcomponents to correct minor misalignments between the subcomponents.

The present invention is directed to an RTA furniture kit having component interface features for tool-less alignment and no fasteners for assembly of a first and second subcomponents, for example, the seating base and backrest. The component interface comprising an elongate polymer KD bracket with a flange and converging side surfaces, the slot having converging edges confirming to the KD bracket. The slot and KD bracket oriented such that gravity and/or friction will prevent relative movement of first and second subcomponents.

In one aspect, a seat base can define an interior cavity sized to receive seat cushions and/or backrest cushions when the sofa is boxed for shipment. The seat base can define corresponding cutouts to combine the interior cavity defined by the set box and the interior cavities defined by each arm rest to increase the space within the seat box-arm rest assembly for receiving, for example, the backrest cushions and furniture components. According to an embodiment, the expanded space can be used to store oversized back or arm rest cushions that would otherwise not fit within the interior space of the seat box. The seat box can comprise an open bottom for accessing the interior cavities of the seat box and the arm rests via the cutouts.

A feature and advantage of embodiments is KD bracket that is formed of a polymer and having a continuous smooth exposed exterior surface without any sharp corners or rigid projections that are present on metal KD brackets. The polymer KD bracket, when mounted to arm rests, providing a low coefficient of friction with respect to material covered panels that define back slots in the backrest into which the polymer KD brackets are received.

The elongate polymer KD bracket may be formed by injection molding with a flange portion and a unitary support portion, the flange portion having an outer wall generally parallel to an interface mounting surface on the support portion with a peripheral lip.

A feature and advantage of embodiments is that the entire weight of the backrest may be carried by the interface between elongate polymer backrest on the arm rests and the slot defining portion of the of the pair of end panels and the interface between the downward face of the lower forward portion of the backrest and the rearward upward face of the seat base.

A feature and advantage is that a ready to assemble (RTA) seat, such as a sofa, that may be shipped in containers from overseas and that takes significantly less space that a fully assembled seat, and that may readily be assembled, without fasteners, by the end user, or a retailer, for example, and that provides an assembled seat when in the use configuration that is as robust and structurally as strong as a non-RTA seat of the same configuration.

When used herein "covered" means when assembled the frame of components are not visible. Material covering may be upholstery, fabric, leather, faux leather, vinyl, or other known flexible furniture coverings.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
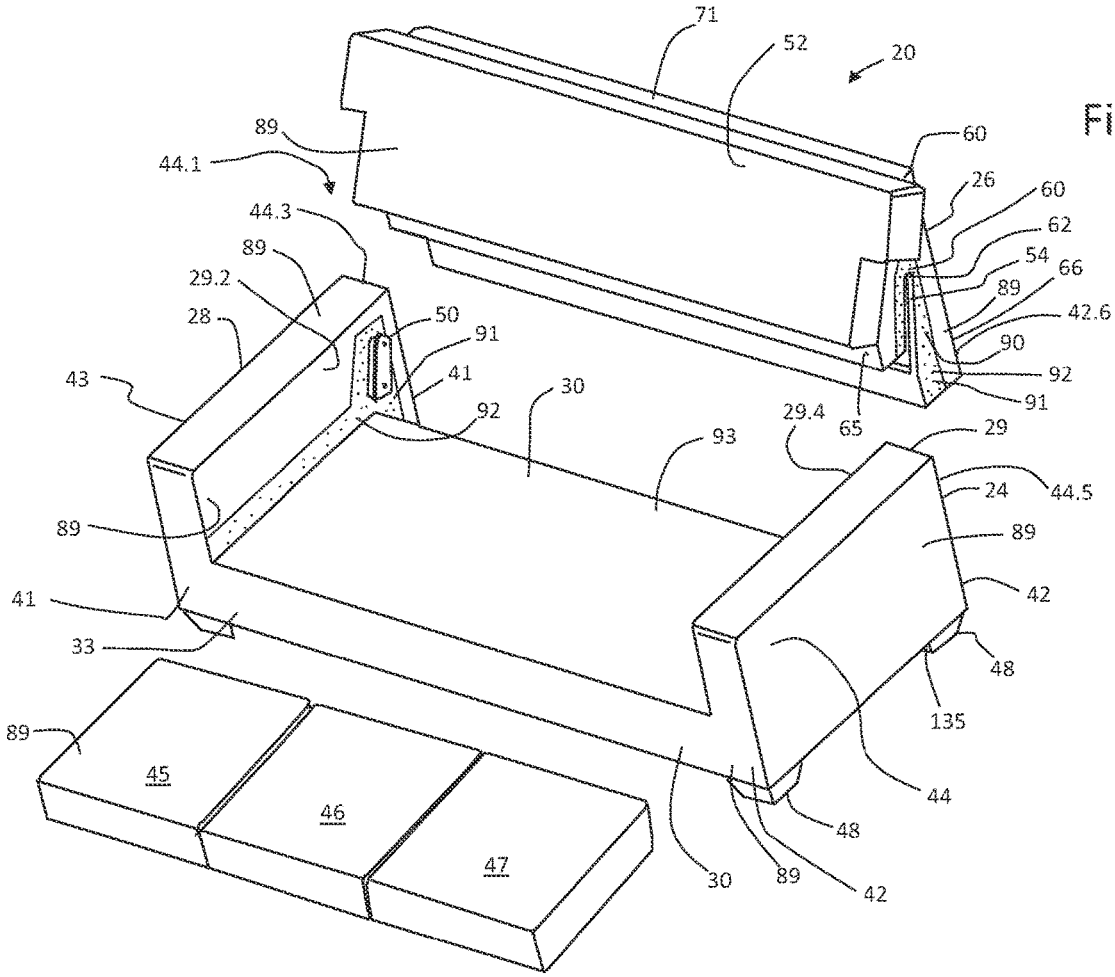
FIG. 1 is a front exploded view of a a down sofa according to an embodiments illustrating a seat base with arm rests, a backrest, and seat cushions.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 2:
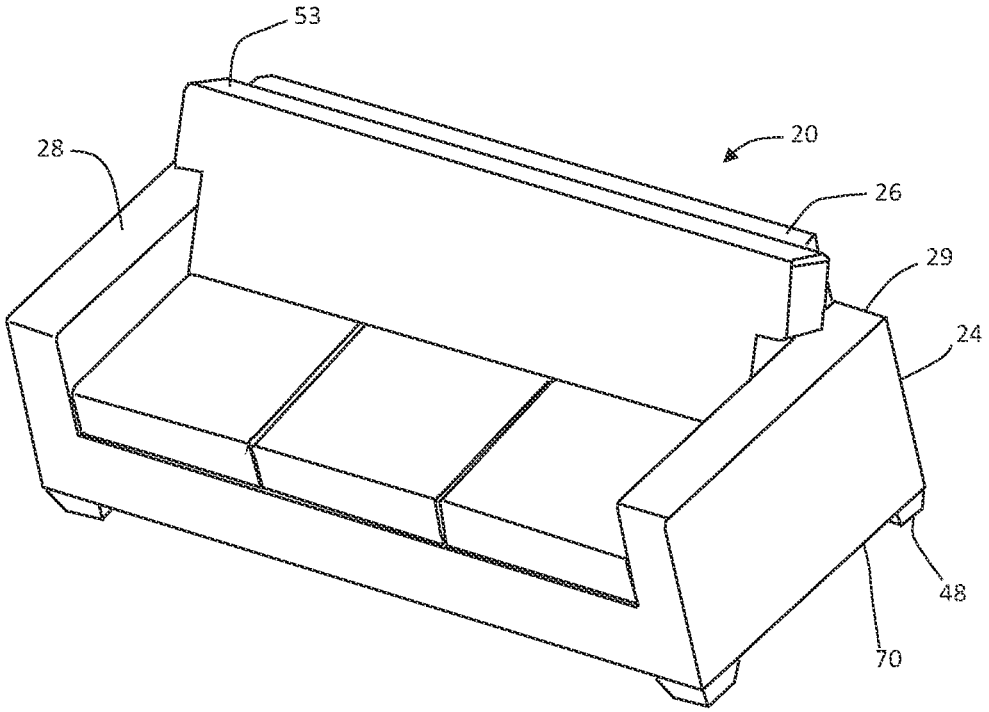
FIG. 2 is a front perspective view of the assembled knock down sofa of FIG. 1.
Figure 5:
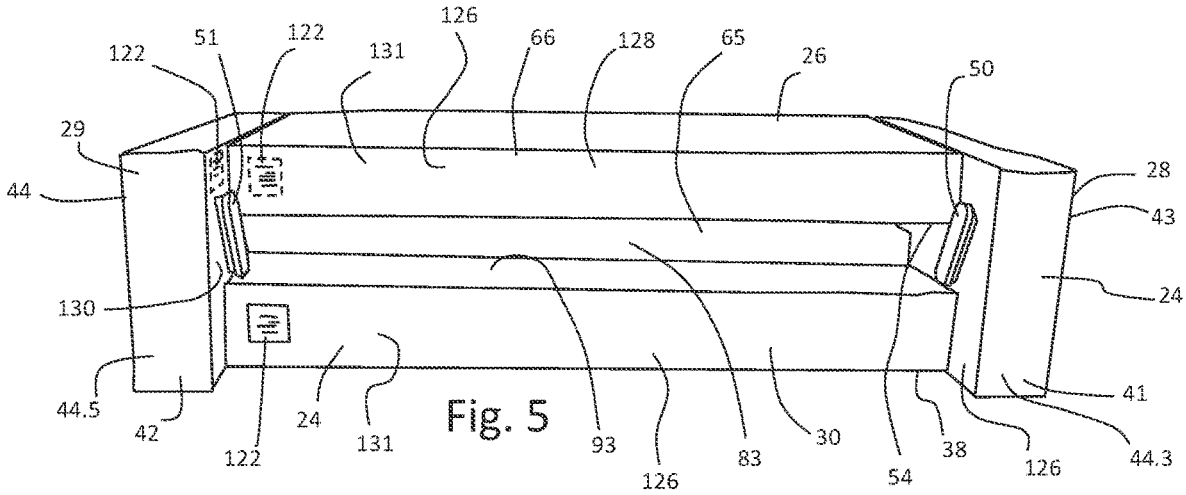
FIG. 5 is a rear perspective view of a sofa in a transport configuration.

Referring to FIGS. 1, 2, and 5, components of an RTA sofa 20 are depicted. The sofa generally comprises a seat base 24 and a backrest 26. FIG. 1 illustrates the sofa in a use configuration with the backrest attached to the seat base and FIG. 5 illustrates the sofa in a transport configuration with the backrest 26 laying on the seat base 24. The seat base having a pair of integrated arm rests 28, 29 and a seating portion 30 extending therebetween. A forward margin 33 of the seating portion 30 being flush with forward margins 34, 35 of the pair of arm rests. A rearward margin 38 of the seating portion 30 being recessed inward from rearward margins 41, 42 of the arm rests 28, 29. When assembled, in embodiments, the rearward margins 41, 42, of the arm rests are flush with a rearward margin 42.6 of the backrest. When viewed from the front of or the rear of the seat base, the arm rests and seating portion defining a U-shape, with the arm rests having upwardly projecting portions 43, 44. The footprint of the seat base, and the view from above, is a U-shaped footprint 44.1, with the seating portion 30 defining the lower leg of the U and rearwardly projecting portions 44.3, 44.5 of the arm rests defining the two lateral legs of the U. Seat cushions 45, 46, 47 are placeable on the seat base 24 as shown in FIG. 2 with the sofa in the use or assembled configuration. Four feet 48 are attachable to the bottom side of the seat base at four corners 49 of the seat base. A pair of elongate polymer KD brackets 50, 51 are secured to each of the arm rests 28, 29 at inwardly facing sides 29.2, 29.4 of the arm rests in an upright orientation with a rearward inclination as shown in FIGS. 1, 5 and 8.

Figure 7:
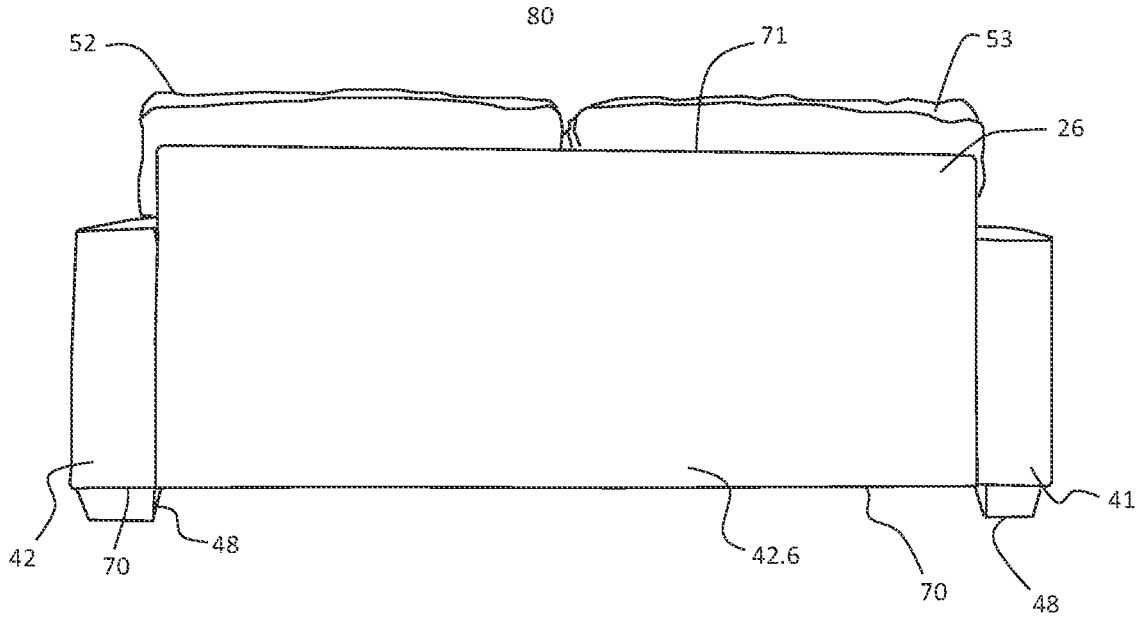
FIG. 7 is a rear perspective view of sofa of FIGS. 5 and 6 with the backrest lower onto the elongate polymer KD brackets converting the sofa from the transport configuration to the use configuration.

Referring to FIGS. 1, 2, 5, and 7 the backrest 26, as depicted, may have an attached backrest cushion 52 or a plurality of cushions 52, 53 as illustrated in FIG. 7. In embodiments, the backrest cushion or cushions may be separate or separable or attached as part of the backrest. When viewed from the side, in embodiments, in particular embodiments excluding the backrest cushions as part of the backrest, the backrest may have the shape of a forwardly inclined number seven (7) when viewed from the right side of the backrest, see FIG. 1, and a mirror image of a forwardly inclined number 7 when viewed from the opposite side, with slots 54, 55 with edge portions 59, converging toward a bracket seating stop 60 at the top 62 of the slot, dividing a forward portion 65 of the backrest 26 from a rearward portion 66 of the backrest, the forward portion joining the rearward portion at an upper portion 68. The rearward portion 66 extends from a lower margin 70 of the sofa, not including the feet, to an upper margin 71 of the sofa and backrest, not including backrest cushions 52, 53 as best shown in FIG. 7. The forward portion 65 of the backrest 26 extends from the upper and rearward portion 78 of the seating portion of the seat base to the upper margin 71 of the sofa and backrest, not including the backrest cushions 53. The bottom surface 83 of the forward portion 65 of the backrest 26 seats on the top surface 85 of the upper and rearward portion 68 of the seating portion 30 of the seat base 24 when the backrest is fully seated on the brackets by way of the slots 54, 55.

The seat base 24, backrest 26, and cushions 45, 46, 47 have exposed general covering material 89 such as upholstery, leather, faux leather, vinyl, or similar material. The regions 90 in proximity to the slots 54, 55 and the region 91 in proximity to the KD brackets 50, 51 may have a thinner not normally exposed material 92, such as a thin fabric, thinner than the exposed covering material 75. The thinner material 92 may also have a lower coefficient of friction compared to the exposed general covering material 89, such as upholstery, when the thinner material 92 interfaces with the elongate polymer KD brackets or with the sofa coverings. A seat deck 93 is positioned on the top of the seating portion of the seating base and may be comprised of stretchable fabric, or spring supported sheet material, or other combinations. See, for example U.S. Pat. Nos. 9,839,295; 9,420,892; 9,839,295; 10,980,354; and 11,344,135 owned by the owner of this application. Said patents are incorporated by reference herein for all purposes. These patents show options for seat decks and backrests that may be suitable for embodiments herein. The slots 95 in the sides of the inward arm rest panels may receive portions of fabric or other material forming the seat deck of the seating portion; see FIG. 3.

Figure 3:
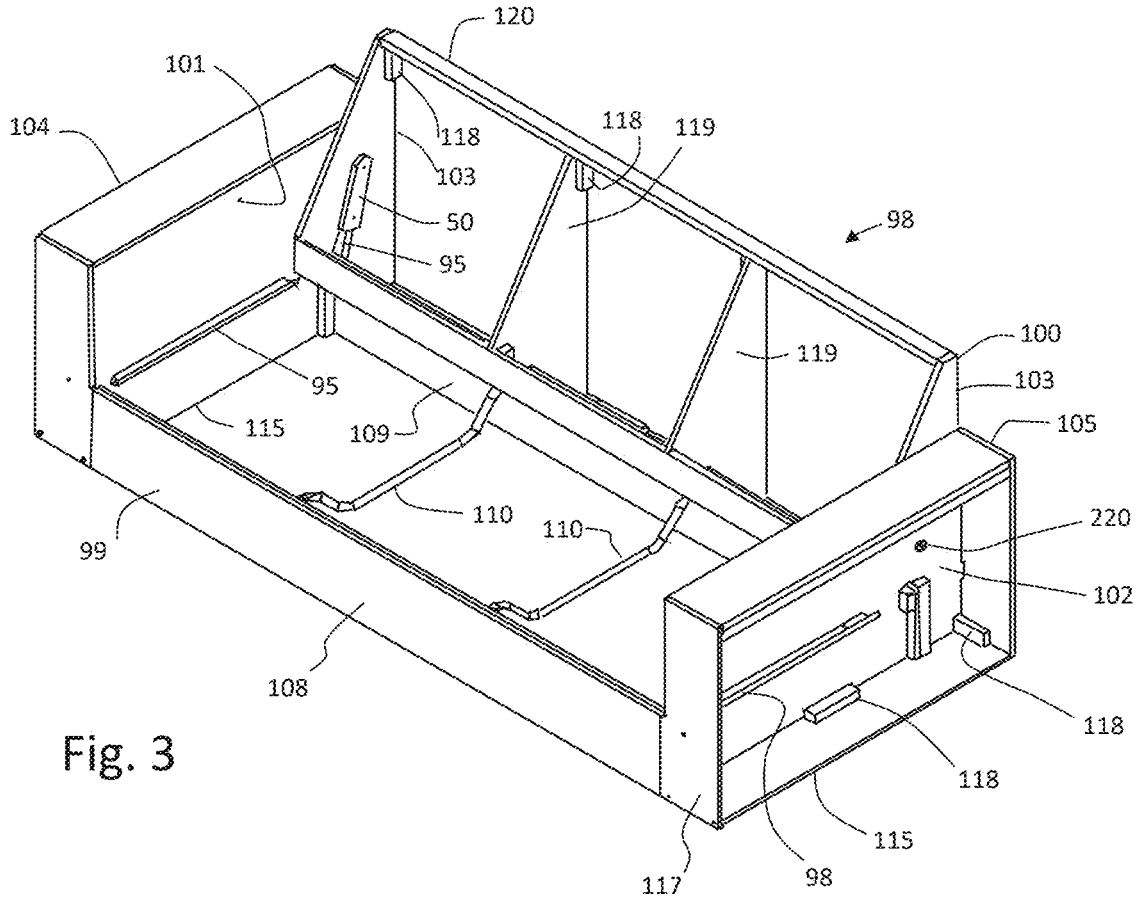
FIG. 3 is a front perspective view of a wood frame of the seat base connected to the wood frame of the backrest according to embodiments.
Figure 8:
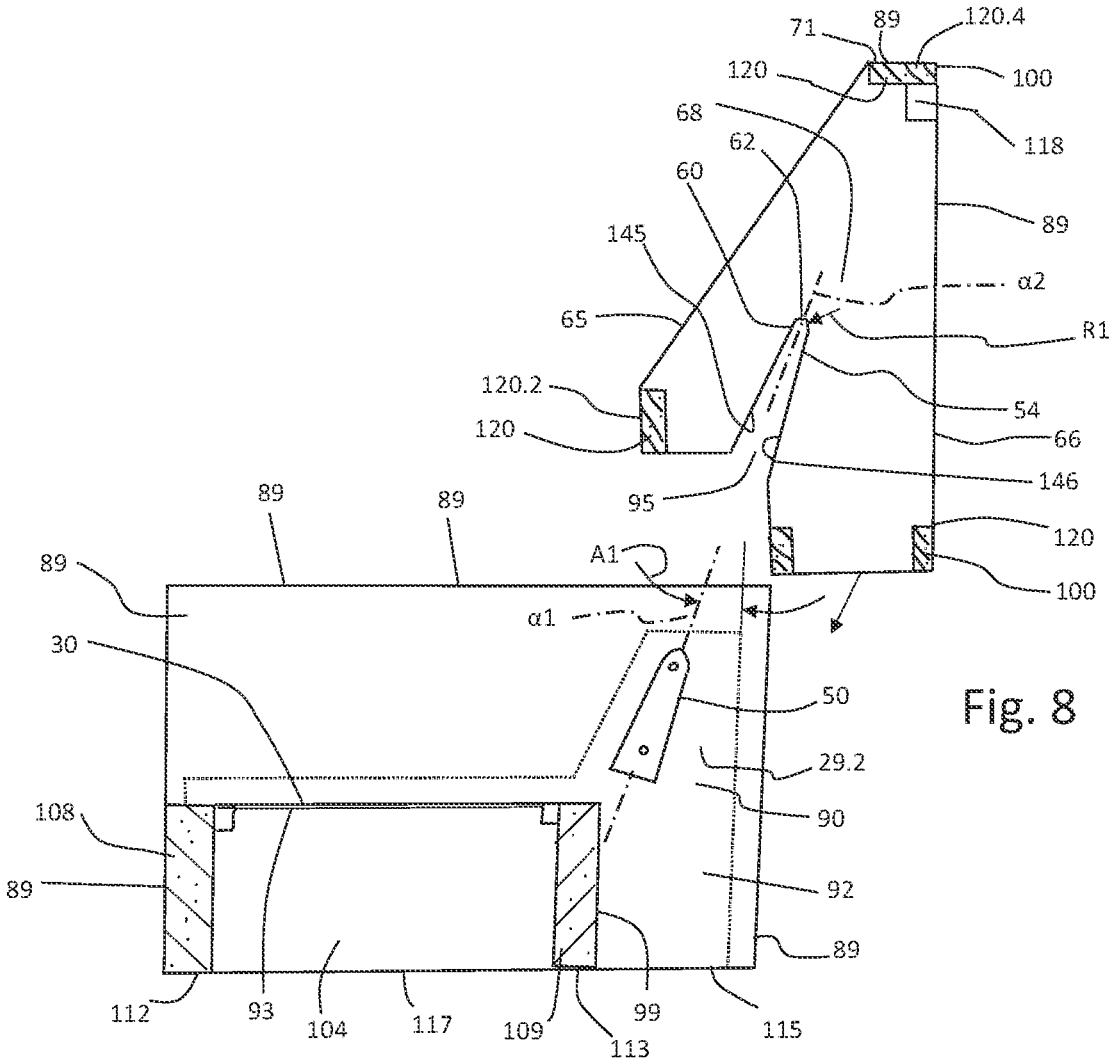
FIG. 8 is a cross sectional view taken approximately at line VIII-VIII of FIG. 6.

Referring to FIGS. 3 and 8, a sofa frame 98 comprising a seat base frame 99 and a separable backrest frame 100 as depicted are secured together by the interface between the elongate polymer KD brackets 50, 51, (only one shown in this view) on the inward panels 101, 102 of the arm rest frames and the slots 95 defined in the side panel frame members 103 of the backrest. Note that in sofas and other seats incorporating the invention, upholstery and material covering the seat base and backrest would be applied at the factory before the attachment of the KD bracket and before the backrest frame and seat base frame are assembled as shown. The assembled sofa frame as depicted in this configuration for illustrative purposes. In embodiments, the frames are formed from wood boards and/or wood products and may be constructed by conventional well known means. See the patents incorporated by reference in the above paragraph for further details and variations on sofa frame construction. Continuing to refer to FIGS. 3 and 8, the seat base frame 99 comprises a pair of arm rest frames 104, 105 with spanning rails including a forward wood base rail 108 and a rearward wood base rail 109, extending left and right between the arm rest frames 104, 105. Seat stretchers 110 extending between the spanning rails. The spanning rails support the seat deck 93. Downward facing lower surfaces 112, 113 of the spanning rails are flush with the downward facing lower surfaces 115 of the arm rest frames. In embodiments, the arm rest frames, are rectangular with perimeter frame members 117 and bracing members 118. The backrest frame 100, in embodiments, has a plurality of upright frame members 119 including the side panel frame members 103, and a plurality of spanning cross members 120 including a breast rail 120.2, an uppermost cross member 120.4 that with upholstery material 89 thereon defines the upper margin 71 of the sofa 20 not including backrest cushions, and that are each attached to each of the plurality of upright frame members and may include wood bracing 118.

In embodiments, portions of the sofa frames may be formed of other materials than wood or wood products. In this regard, see U.S. Pat. Pub. 2022/0071398 owned by the owner of this application and incorporated by reference herein for all purposes.

Figure 4:
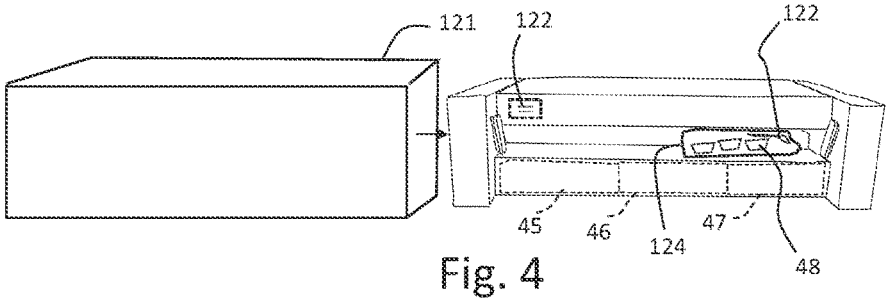
FIG. 4 is a perspective view of a deboxed sofa in a transport configuration in accord with embodiments.

Referring to FIGS. 4 and 5, the sofa is shown in the transport configuration with the backrest 26 nested between the arm rests of the seat base 24 above the seating portion. The transport configuration is amenable to boxing with box 121. The feet 48 along with instructions 122 and documentation may be included in the boxed sofa in a bag 124. Alternatively or additionally, assembly instructions 122 may be secured to normally non visible locations 126 when in the use configuration, such as the rearward facing surface 128 of the seating portion 30 of the seat base 24, or the inward facing surface 130 of an arm rest 28, 29, or the lower surface 131 of the rearward portion 66 of the backrest 26. Seat cushions 45, 46, 47 and/or backrest cushions 52, 53 may be stowed in the transport mode in various locations. For example, open regions in the base, within the seating portion or arm rests, within the backrest between the upright panel members. See, for example, U.S. Pat. Nos. 9,474,381 and 9,380,877 for storage options of cushions during shipment of sofas. Said patents are incorporated herein by reference for all purposes. In embodiments, the cushions may be compressed and stored in a sealed bag under vacuum conditions while in the transport configuration for minimizing size.

Figure 6:
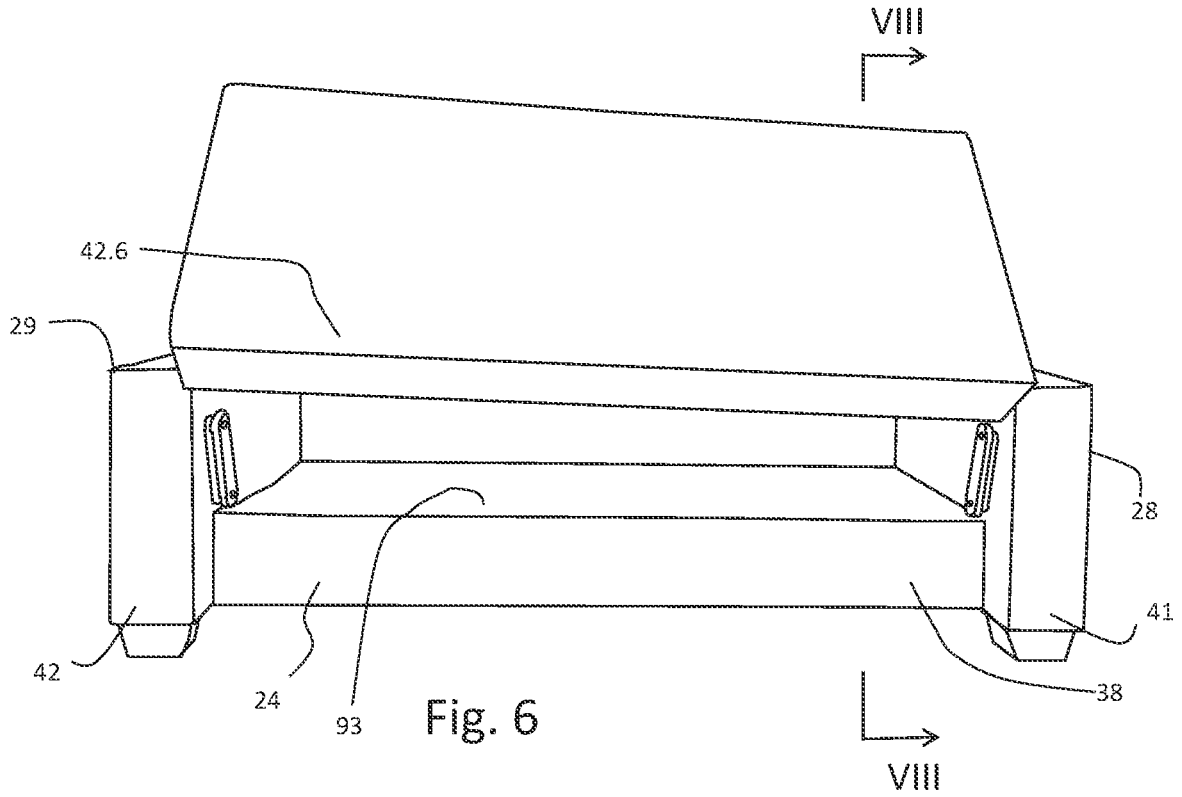
FIG. 6 is a rear perspective view of sofa of FIG. 5 with the backrest raised and rotated rearwardly.

Referring to FIGS. 1, 4, 5, 6, 7, and 8, the assembly steps for converting the sofa 20 in the transport configuration to the use configuration may comprise: unboxing the sofa in the transport configuration, see FIGS. 4 and 5; lifting the backrest upwardly and rotating the upper portion of the backrest rearwardly, see FIG. 6; lowering the backrest onto the KD brackets 50, 51, see FIGS. 1 and 8; and seating the KD brackets into the slots of the seat base arm rests, see FIGS. 2 and 7; removing seat cushions or backrest cushions from within the seat base and/or within the backrest, placement of seat cushions on the seating portion and/or backrest cushions against the backrest, see FIGS. 4 and 1, and attaching the feet which may be by screwing screw projections on the feet into cooperating preplaced holes in the sofa frame at the bottom side corners 135 of the sofa, see FIG. 1. The backrest secured to the seat base with the slots of the backrest engaged and seated on the KD brackets of the seat base and retained thereon by gravity.

The positioning of the slots 54, 55 in close proximity to the KD brackets 50, 51 when the sofa is in the transport configuration, and the simple, lift, rotate, and seating of the backrest on the KD brackets of the seat base, and the attachment of the feet for conversion to the use configuration, the movement of the cushions on the seat and/or backrest, and the fact that no other fasteners or assembly steps are needed, allows for the simplistic instructions 122 that can be permanently mounted in inconspicuous locations as best shown in FIGS. 4 and 5. The assembly steps can further comprise reading the instructions attached to the sofa or separate paper instructions.

Referring to FIGS. 1, and 8-14, details of embodiments of the elongate polymer KD bracket 50, 51 are illustrated, along with details of attachment of the KD brackets to the upright side panels that are part of the backrest frame. The KD brackets are suitably positioned above and rearward of the seating portion 30 of the seat base 25. The brackets have a lengthwise axis $\alpha 1$ that as mounted is inclined rearwardly as illustrated. The inclination angle A1, as illustrated best in FIG. 8, may be in a range of from about 10° to about 500 in embodiments. In embodiments, the range of angle A1 may be from 20° to 45°. In embodiments, the range of angle A1 may be from 25° to 35°. Each slot has an axis $\alpha 2$ that bifurcates the open angle defined by the opposing edges 145, 146 of the slot. When assembled the axis $\alpha 1$ of the KD bracket is in alignment with the axis $\alpha 2$ of the respective slot. When viewed from the front, in embodiments, $\alpha 1$ and $\alpha 2$ do not have any inclination.

Figure 14:
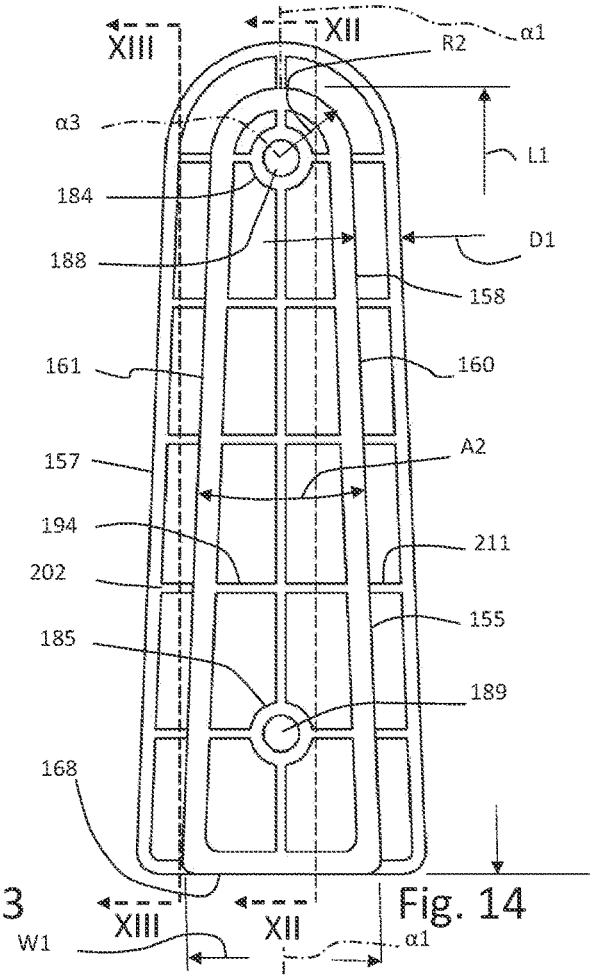
FIG. 14 is a rear elevation view of the elongate polymer KD bracket of FIGS. 10-13.
Figure 15:
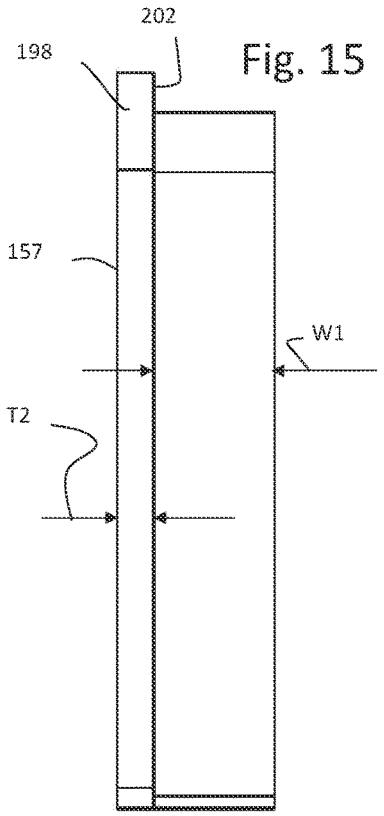
FIG. 15 is a side elevation view of the elongate polymer KD bracket of FIGS. 10-14.
Figure 16:
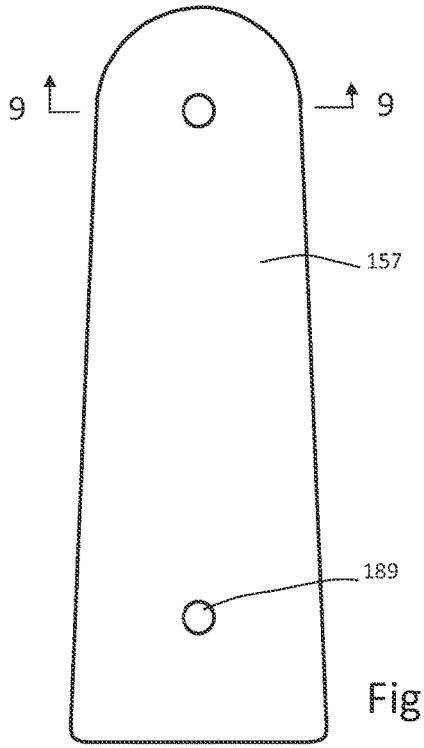
FIG. 16 is a front elevation view of the elongate polymer KD bracket of FIGS. 10-15.
Figure 17:
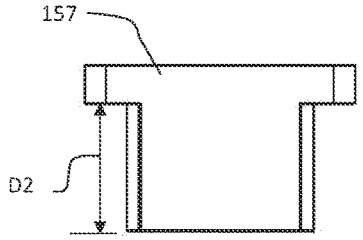
FIG. 17 is a top end view of the elongate polymer KD bracket of FIGS. 10-16.
Figure 18:
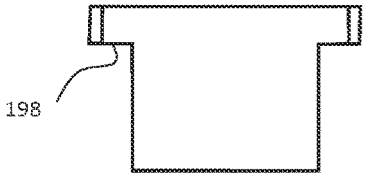
FIG. 18 is a bottom end view of the elongate polymer KD bracket of FIGS. 10-17.

In embodiments, the elongate polymer KD bracket 50, 51 has a body portion configured as a wedge portion 155, and a flange portion 157. Each bracket having generally a triangular shape with rounded corners. Referring, in particular to FIG. 14, in embodiments, the wedge portion 155 is defined by a circumferential wall 158 that provides opposing exterior planar engagement surfaces 160, 161 that converge toward one another, and an arcuate or partial cylindrical upper surface 163 at a leading end 165. The leading end 165 is leading in the sense of insertion of the bracket into the respective slot, this end goes in first. A trailing end 167 has a flattened end surface 168 and a flat trailing end. The leading end 165 engages the respective conforming slot which has a radius of curvature R1 that is substantially the same as or minimally bigger than the radius of curvature R2 of the leading end of the wedge portion. The radius of curvature of the leading end, in an embodiment, may be in the range of about 12 to 20 mm, for example. The radius of curvature of the leading end, in another embodiment, may be in the range of about 14 to 18 mm, for example. The length L1 of the wedge portion, in embodiments, may be in the range of from 120 mm to 220 mm. The length L1 of the wedge portion, in embodiments, may be in the range of from 150 mm to 190 mm. The length L1 of the wedge portion, in embodiments, may be in the range of from 164 mm to 186 mm. In embodiments, the maximum width W1 of the wedge portion is in the range of 30 mm to 100 mm. In embodiments, the maximum width W1 of the wedge portion is in the range of 24 mm to 90 mm. In embodiments, the maximum width W1 of the wedge portion is in the range of 30 mm to 80 mm. In embodiments, the maximum width W1 of the wedge portion is in the range of 30 mm to 60 mm. In embodiments, the maximum width W1 of the wedge portion is in the range of 40 mm to 48 mm. In embodiments, the opposing exterior planar surfaces 160, 161 of the wedge portion 155 have an angulation A2 between them of 5° to 32°. In embodiments, the opposing exterior planar surfaces 160, 161 of the wedge portion 155 have an angulation A2 between them of 9° to 27°. In embodiments, the opposing exterior planar surfaces 160, 161 of the wedge portion 155 have an angulation A2 between them of 12° to 20°. In embodiments, the opposing exterior planar surfaces 160, 161 of the wedge portion 155 have a angulation A2 between them of about 16°. In embodiments, the thickness T1 of the circumferential wall is in the range of 2 to 8 mm. In embodiments, the thickness T1 of the circumferential wall is in the range of 4 to 6 mm. In embodiments, the thickness T1 of the circumferential wall is about 5 mm.

In embodiments, the KD bracket has a pair of bosses 184, 185 positioned along the lengthwise axis α1 of the brackets with respective through holes 188, 189 position in each boss. The first through hole 188 has an axis in alignment with the axis of curvature α3 of the leading end. The circumferential wall 158 of the wedge portion and the flange portion 157 define an interior 190 of the bracket. The KD bracket has webbing 194 positioned in the interior that extends between and is unitary with each of the two bosses, the circumferential wall 158 and the flange portion 157. The webbing supports the bosses and provide overall structural strength of the bracket.

The flange portion 157 is unitary with the circumferential wall and webbing 194. The flange portion, in embodiments, may have a thickness T2 of the flange that is exterior of the circumferential wall in the range of from 4 to 20 mm. The flange portion 157, in embodiments, may have a thickness T2 of the flange that is exterior of the circumferential wall in the range of from 6 to 15 mm. The flange portion, in embodiments, may have a thickness T2 of the flange that is exterior of the circumferential wall of about 9 mm. The flange portion, in embodiments is shaped to be conforming to the shape of the wedge portion, provides a lip 198 or overhang portion that captures the edge portions of the wood upright panels of the backrest at the respective slots 54, 55. In embodiment, the lip does not extend outward and about the trailing end 167 of the wedge portion 155. In embodiments, the overhang distance D1 of the flange portion 157 is about 10 mm. In embodiments, the overhang distance D1 is in the range of 5 mm to 25 mm. In embodiments, the overhang distance D1 is in the range of 8 mm to 12 mm. In embodiments, webbing 211 extends between a skirt portion 212 of the lip and the wedge portion. In embodiments, the distance D2 between the overhang 198 and the plane of the attachment side of the bracket is in the range of 15 to 40 mm. In embodiments, the distance D2 between the overhang 198 and the plane of the attachment side of the bracket is in the range of 15 to 40 mm. In embodiments, the distance D2 is sized to the thickness of the side panel frame members at the slots 54, 55 such that a snug fit is provided. In embodiments, the distance D2 correlates to within 10% of the thickness of the side panel frame members 103 at the slot edges. In embodiments, the distance D2 correlates to within 5% of the thickness of the side panel frame members 103 at the slot edges.

Figure 9A:
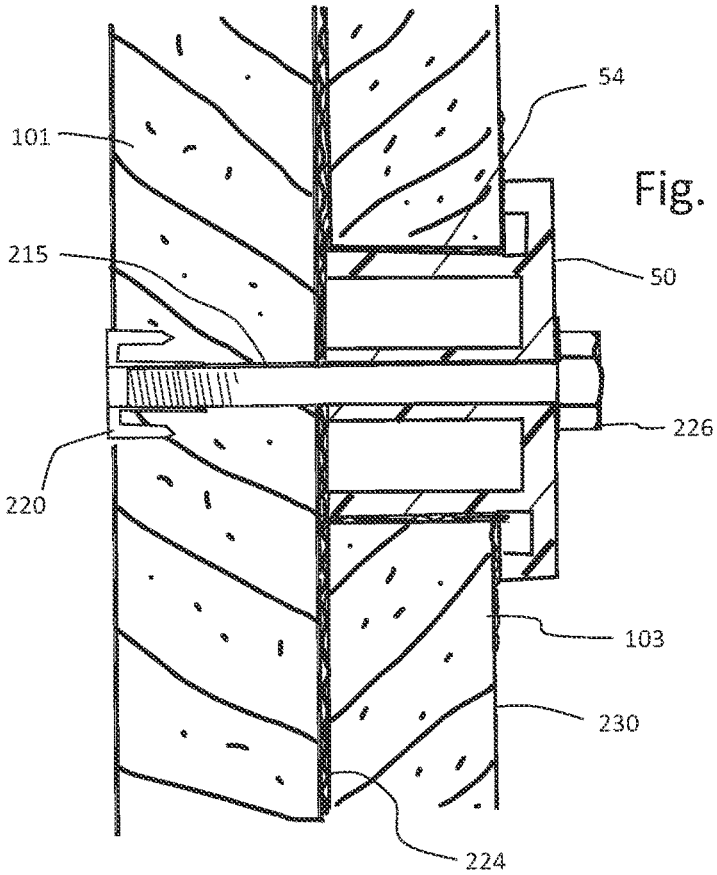
FIG. 9A is a cross sectional view taken through a KD bracket with the backrest connected to the seat base.
Figure 9B:
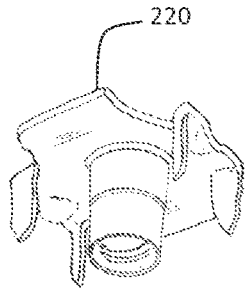
Fig. 9B Prior Art
FIG. 9B is a Prior Art perspective view of the T-nut of FIG. 9A.
Figure 10:
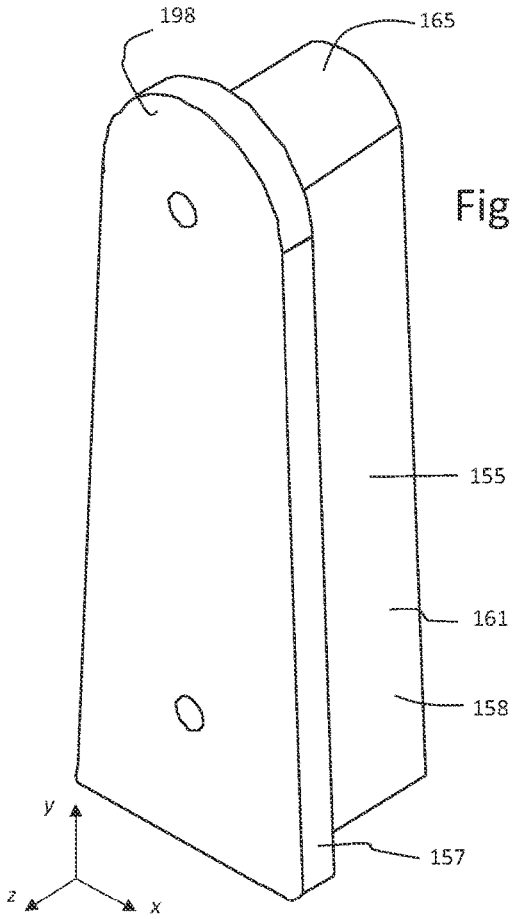
FIG. 10 is a front perspective view of an elongate polymer KD bracket in accord with embodiments.
Figure 11:
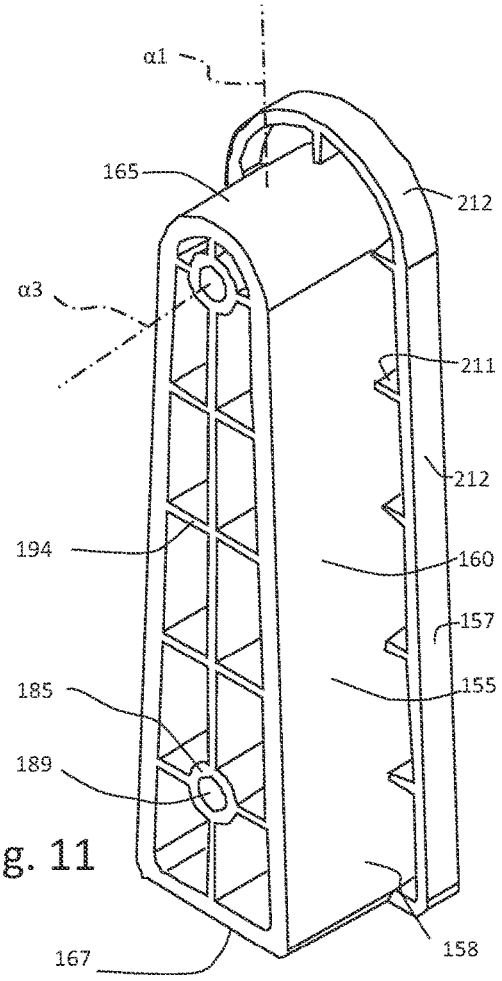
FIG. 11 is a rear perspective view of the elongate polymer KD bracket of FIG. 8.
Figure 12:
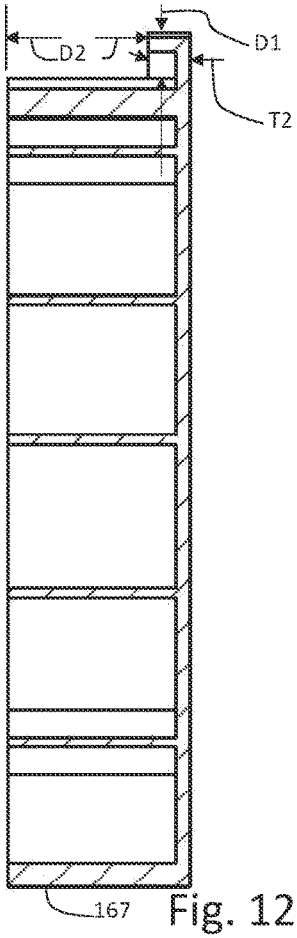
FIG. 12 is a cross sectional view of the elongate polymer KD bracket of FIGS. 10 and 11 taken at line XII-XII of FIG. 14.
Figure 13:
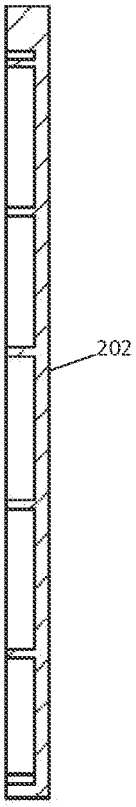
FIG. 13 is a cross sectional view of the elongate polymer KD bracket of FIGS. 10-12 taken at line XIII-XIII of FIG. 14.

Referring to FIGS. 9A and 9B, a cross sectional view at a plane extending through a KD bracket 50 at the upper through hole 188, the KD bracket fastened to the inward panel 101 of the arm rest 28 of the seat base 24. The inward panel has a hole 215 drilled therein and a T-nut 220 embedded into the inside surface 222 of the inward panel 101. The KD bracket is connected to the inward panel at the exterior surface 224 by a bolt 226 extending through the through hole 188 of the KD bracket 50 and aligned with the hole 215 in the inward panel 101 of the frame of the arm rest of the seat base. The material covering the seat base may be attached to the inward panel prior to the attachment of the KD bracket 50. The KD bracket 50 may also be similarly attached to the inward panel 101 at the second through hole 189. The slot 54 of the side panel frame member 103 receives the KD bracket 50 and is conformingly sized and shaped such that there is little or no gap between the wedge portion 155 and the edge surfaces at the slot 54. And little or no gap between the overhang portion 198 and the inward surface 230 of the panel frame member 103. That is the thickness and cut of the slot is carefully controlled to prevent such gaps.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims. For example, although embodiments herein have described seats with the arm rests already secured at the factory and attached in the RTA box, in embodiments, the novel KD bracket herein could be utilized for attaching the arm rests to the base, or a sofa could be configured utilizing the KD brackets disclosed without arm rests. The KD bracket, in embodiments, may have a flange portion not shaped to correspond to the body portion, and the body portion may be other than wedge shaped, it may, for example have opposing parallel surfaces and a rounded trailing end.

All the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features. When "about" is used herein with reference to a parameter, about means within 5% of the stated parameter.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A ready to assemble boxed sofa in a transport mode and convertible to an assembled use mode, the sofa comprising:

a wood framed seat base with a pair of arm rests and a seating portion extending between the arm rests, the arm rests having a pair of elongate KD brackets on inward facing surfaces of each of the pair of arm rests, each KD bracket having a wedge portion on the inward facing surface and a flange portion unitary with the wedge portion and displaced from the inward facing surface, wherein each bracket is attached with two bolts extending through two through holes in the respective bracket and threadingly engaged with T-nuts embedded in a respective arm rest frame member;

a wood framed backrest, the backrest having a pair of panel frame members with slots therein sized to the wedge portion of the KD brackets, the wood framed backrest positioned above the seating portion of the seat base and between the pair of arm rests and rotatable and lowerable to a seating position on the wood framed seat base constituting the use mode;

instructions for assembling the ready to assemble boxed sofa; and a box containing the wood framed seat base, the wood framed backrest, and the instructions.

* * * * *